US009970242B2

(12) United States Patent
Narikawa et al.

(10) Patent No.: US 9,970,242 B2
(45) Date of Patent: May 15, 2018

(54) GALLING RESISTANT DRILL PIPE TOOL JOINT AND CORRESPONDING DRILL PIPE

(71) Applicant: TENARIS CONNECTIONS B.V., Amsterdam (NL)

(72) Inventors: Tomoyuki Narikawa, Kawasaki (JP); Tatsuo Ono, Kawasaki (JP); Koji Sakura, Kawasaki (JP); Toshihiko Fukui, Kawasaki (JP); Motohisa Yoshida, Kawasaki (JP); Takeshi Kuwano, Kawasaki (JP); Nobuo Kobayashi, Kawasaki (JP); Nobuhide Sato, Kawasaki (JP)

(73) Assignee: Tenaris Connections B.V., Amsterdam (NL)

( * ) Notice: Subject to any disclaimer, the term of this patent is extended or adjusted under 35 U.S.C. 154(b) by 0 days. days.

(21) Appl. No.: 14/760,300

(22) PCT Filed: Jan. 11, 2013

(86) PCT No.: PCT/IB2013/050265

§ 371 (c)(1),
(2) Date: Jul. 10, 2015

(87) PCT Pub. No.: WO2014/108756

PCT Pub. Date: Jul. 17, 2014

(65) Prior Publication Data

US 2015/0368986 A1 Dec. 24, 2015

(51) Int. Cl.
*E21B 17/042* (2006.01)
*E21B 17/00* (2006.01)
(Continued)

(52) U.S. Cl.
CPC ..... *E21B 17/042* (2013.01); *E21B 17/00* (2013.01); *E21B 19/16* (2013.01); *C25D 7/04* (2013.01)

(58) Field of Classification Search
USPC ..... 166/380, 242.1; 285/333
See application file for complete search history.

(56) References Cited

U.S. PATENT DOCUMENTS 141,451 A * 8/1873 Speller ..... A22C 11/02 452/42
1,590,357 A 6/1926 Feisthamel
(Continued)

FOREIGN PATENT DOCUMENTS

AR 0050159 A1 10/2006
AT 388791 B 8/1989
(Continued)

OTHER PUBLICATIONS

Fritz T et al, "Characterization of electroplated nickel", Microsystem Technologies, Dec. 31, 2002, vol. 9, No. 1-2, pp. 87-91, Berlin, DE.
(Continued)

*Primary Examiner* — Taras P Bemko
(74) *Attorney, Agent, or Firm* — Knobbe Martens Olson & Bear LLP

(57) ABSTRACT

Disclosed herein are embodiments of a drill pipe tool joint and a drill pipe which are optimized for repeated make-up/break-out operations without the use of screw grease. Embodiments of the disclosure are environment friendly as well as having improved operating efficiency. In particular, the box and pin can be formed from different materials having different hardness.

30 Claims, 5 Drawing Sheets

(51) Int. Cl.
*E21B 19/16* (2006.01)
*C25D 7/04* (2006.01)

(56) References Cited

U.S. PATENT DOCUMENTS 1,671,458 A 5/1928 Wilson
1,799,762 A 1/1929 Rathbun
1,999,706 A 4/1935 Spang
2,075,427 A 3/1937 Church
2,211,173 A 8/1940 Shaffer
2,636,753 A 4/1948 Griffin
2,487,241 A 11/1949 Hilton
2,539,057 A 1/1951 Brown
2,567,113 A 9/1951 Kristensen
2,631,871 A 3/1953 Stone
2,634,943 A 4/1953 Gulick
2,841,429 A 10/1955 McCuistion
2,766,998 A 10/1956 Watts et al.
2,916,306 A 12/1959 Rickard
2,992,021 A 7/1961 Nay
2,992,613 A 7/1961 Bodine
3,016,250 A 1/1962 Franck
3,041,088 A 6/1962 Brandon
3,054,628 A 9/1962 Hardy et al.
3,150,889 A 9/1964 Watts
3,219,354 A 11/1965 Kazienko
3,266,824 A 8/1966 Nealy
3,307,860 A 3/1967 Blount et al.
3,316,395 A 4/1967 Lavin
3,316,396 A 4/1967 Lavin
3,325,174 A 6/1967 Weaver
3,362,731 A 1/1968 Gasche et al.
3,366,392 A 1/1968 Kennel
3,413,166 A 11/1968 Zackay et al.
3,489,437 A 1/1970 Duret
3,512,789 A 5/1970 Tanner
3,552,781 A 1/1971 Helland
3,572,777 A 3/1971 Blose et al.
3,575,430 A 4/1971 Alpine
3,592,491 A 7/1971 Glover
3,599,931 A 8/1971 Hanson
3,655,465 A 4/1972 Snape et al.
3,733,093 A 5/1973 Seiler
3,810,793 A 5/1974 Heller
3,854,760 A 12/1974 Duret
3,889,989 A 6/1975 Legris et al.
3,891,224 A 6/1975 Ditcher
3,893,919 A 7/1975 Flegel et al.
3,915,697 A 10/1975 Giuliani et al.
3,918,726 A 11/1975 Kramer
3,986,731 A 10/1976 DeHoff
4,014,568 A 3/1977 Carter et al.
4,147,368 A 4/1979 Baker et al.
4,163,290 A 7/1979 Sutherlin et al.
4,219,204 A 8/1980 Pippert
4,231,555 A 11/1980 Saito
4,299,412 A 10/1981 Parmann
4,305,059 A 12/1981 Benton
4,310,163 A 1/1982 Pippert
4,336,081 A 6/1982 Hijikata et al.
4,345,739 A 8/1982 Wheatley
4,354,882 A 10/1982 Greer
4,366,971 A 1/1983 Lula
4,368,894 A 1/1983 Parmann
4,373,750 A 2/1983 Mantelle et al.
4,376,528 A 3/1983 Ohshimatani et al.
4,379,482 A 4/1983 Suzuki et al.
4,384,737 A 5/1983 Reusser
4,406,561 A 9/1983 Ewing
4,407,681 A 10/1983 Ina et al.
4,426,095 A 1/1984 Buttner
4,445,265 A 5/1984 Olson et al.
4,468,309 A 6/1984 White
4,473,471 A 9/1984 Robichaud et al.
4,475,839 A 10/1984 Strandberg
4,491,725 A 1/1985 Pritchard
4,506,432 A 3/1985 Smith
4,526,628 A 7/1985 Ohno et al.
4,527,815 A 7/1985 Frick
4,564,392 A 1/1986 Ohhashi et al.
4,570,982 A 2/1986 Blose et al.
4,591,195 A 5/1986 Chelette et al.
4,592,558 A 6/1986 Hopkins
4,601,491 A 7/1986 Bell, Jr. et al.
4,602,807 A 7/1986 Bowers
4,623,173 A 11/1986 Handa et al.
4,629,218 A 12/1986 Dubois
4,662,659 A 5/1987 Blose et al.
4,674,756 A 6/1987 Fallon et al.
4,688,832 A 8/1987 Ortloff et al.
4,706,997 A 11/1987 Carstensen
4,710,245 A 12/1987 Roether
4,721,536 A 1/1988 Koch et al.
4,758,025 A 7/1988 Frick
4,762,344 A 8/1988 Perkins et al.
4,812,182 A 3/1989 Fang et al.
4,814,141 A 3/1989 Imai et al.
4,844,517 A 7/1989 Beiley et al.
4,856,828 A 8/1989 Kessler et al.
4,955,645 A 9/1990 Weems
4,958,862 A 9/1990 Cappelli et al.
4,988,127 A 1/1991 Cartensen
5,007,665 A 4/1991 Bovisio et al.
5,067,874 A 11/1991 Foote
5,137,310 A 8/1992 Noel et al.
5,143,381 A 9/1992 Temple
5,154,534 A 10/1992 Guerin et al.
5,180,008 A 1/1993 Aldridge et al.
5,191,911 A 3/1993 Dubois
5,242,199 A 9/1993 Hann et al.
5,328,158 A 7/1994 Lewis et al.
5,348,350 A 9/1994 Blose et al.
5,352,406 A 10/1994 Barteri et al.
5,360,239 A * 11/1994 Klementich ..... F16L 15/001 285/328
5,445,683 A * 8/1995 Tahara ..... C23C 8/24 148/317
5,454,883 A 10/1995 Yoshie et al.
5,505,502 A 4/1996 Smith et al.
5,515,707 A 5/1996 Smith
5,538,566 A 7/1996 Gallagher
5,592,988 A 1/1997 Meroni et al.
5,598,735 A 2/1997 Saito et al.
5,653,452 A 8/1997 Järvenkylä
5,712,706 A 1/1998 Castore et al.
5,794,985 A 8/1998 Mallis
5,810,401 A 9/1998 Mosing et al.
5,860,680 A 1/1999 Drijver et al.
5,879,030 A 3/1999 Clayson et al.
5,879,474 A 3/1999 Bhadeshia et al.
5,944,921 A 8/1999 Cumino et al.
5,993,570 A 11/1999 Gray
6,006,789 A 12/1999 Toyooka et al.
6,030,470 A 2/2000 Hensger et al.
6,044,539 A 4/2000 Guzowksi
6,045,165 A 4/2000 Sugino et al.
6,056,324 A 5/2000 Reimert et al.
6,070,912 A 6/2000 Latham
6,173,968 B1 1/2001 Nelson et al.
6,188,037 B1 2/2001 Hamada et al.
6,196,530 B1 3/2001 Muhr et al.
6,217,676 B1 4/2001 Takabe et al.
6,248,187 B1 6/2001 Asahi et al.
6,257,056 B1 7/2001 Shibayama et al.
6,267,828 B1 7/2001 Kushida et al.
6,311,965 B1 11/2001 Muhr et al.
6,331,216 B1 12/2001 Toyooka et al.
6,347,814 B1 2/2002 Cerruti
6,349,979 B1 2/2002 Noel et al.
6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.

(56) References Cited

U.S. PATENT DOCUMENTS 6,494,499 B1 12/2002 Galle, Sr. et al.
6,514,359 B2 2/2003 Kawano
6,527,056 B2 3/2003 Newman
6,550,822 B2 4/2003 Mannella et al.
6,557,906 B1 5/2003 Carcagno
6,558,484 B1 * 5/2003 Onoe ..... C21D 9/0093 148/333
6,581,940 B2 6/2003 Dittel
6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Morotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura
7,083,686 B2 8/2006 Itou
7,108,063 B2 9/2006 Carstensen
7,118,637 B2 10/2006 Kusinski et al.
7,182,140 B2 2/2007 Wood
7,214,278 B2 5/2007 Kusinski et al.
7,255,374 B2 8/2007 Carcagno et al.
7,264,684 B2 9/2007 Numata et al.
7,284,770 B2 10/2007 Dell'erba et al.
7,310,867 B2 12/2007 Corbett, Jr.
7,431,347 B2 10/2008 Ernst et al.
7,464,449 B2 12/2008 Santi et al.
7,475,476 B2 1/2009 Roussie
7,478,842 B2 1/2009 Reynolds, Jr. et al.
7,506,900 B2 3/2009 Carcagno et al.
7,621,034 B2 11/2009 Roussie
7,635,406 B2 12/2009 Numata et al.
7,735,879 B2 6/2010 Toscano et al.
7,744,708 B2 6/2010 López et al.
7,752,416 B2 7/2010 Mazzaferro et al.
7,753,416 B2 7/2010 Mazzaferro et al.
7,862,667 B2 1/2011 Turconi et al.
8,002,910 B2 8/2011 Tivelli et al.
8,007,601 B2 8/2011 López et al.
8,007,603 B2 8/2011 Garcia et al.
8,016,362 B2 9/2011 Itoga
8,215,680 B2 7/2012 Nestor
8,262,094 B2 9/2012 Beele
8,262,140 B2 9/2012 Santi et al.
8,317,946 B2 11/2012 Arai et al.
8,328,958 B2 12/2012 Turconi et al.
8,333,409 B2 12/2012 Santi et al.
8,414,715 B2 4/2013 Altschuler et al.
8,544,304 B2 10/2013 Nestor
8,636,856 B2 1/2014 Altschuler et al.
8,821,653 B2 9/2014 Anelli et al.
8,840,152 B2 9/2014 Carcagno et al.
8,926,771 B2 1/2015 Agazzi
9,004,544 B2 4/2015 Carcagno et al.
9,163,296 B2 10/2015 Valdez et al.
9,187,811 B2 11/2015 Gomez et al.
9,188,252 B2 11/2015 Altschuler et al.
9,222,156 B2 12/2015 Altschuler et al.
9,383,045 B2 7/2016 Santi et al.
2001/0035235 A1 11/2001 Kawano
2002/0011284 A1 1/2002 Von Hagen et al.
2002/0153671 A1 10/2002 Raymond et al.
2002/0158469 A1 10/2002 Mannella et al.
2003/0019549 A1 1/2003 Turconi et al.
2003/0111146 A1 6/2003 Kusinski et al.
2003/0116238 A1 6/2003 Fujita
2003/0155052 A1 8/2003 Kondo et al.
2003/0165098 A1 9/2003 Ohara et al.
2003/0168859 A1 9/2003 Watts
2004/0118490 A1 6/2004 Klueh et al.
2004/0118569 A1 6/2004 Brill et al.
2004/0131876 A1 7/2004 Ohgami et al.
2004/0139780 A1 7/2004 Cai et al.
2004/0151608 A1 8/2004 Vogt et al.
2004/0195835 A1 10/2004 Noel et al.
2004/0262919 A1 12/2004 Dutilleul et al.
2005/0012278 A1 1/2005 Delange
2005/0076975 A1 4/2005 Lopez et al.
2005/0087269 A1 4/2005 Merwin
2005/0093250 A1 5/2005 Santi et al.
2005/0166986 A1 8/2005 Dell'erba et al.
2006/0006600 A1 1/2006 Roussie
2006/0124211 A1 6/2006 Takano et al.
2006/0137781 A1 6/2006 Kusinski et al.
2006/0169368 A1 8/2006 Lopez et al.
2006/0231168 A1 10/2006 Nakamura et al.
2006/0243355 A1 11/2006 Haiderer et al.
2006/0273586 A1 12/2006 Reynolds, Jr. et al.
2007/0039149 A1 2/2007 Roussie
2007/0089813 A1 4/2007 Tivelli
2007/0137736 A1 6/2007 Omura et al.
2007/0200345 A1 8/2007 Toscano et al.
2007/0216126 A1 9/2007 Lopez et al.
2007/0246219 A1 10/2007 Manella et al.
2008/0047635 A1 2/2008 Konda et al.
2008/0115863 A1 5/2008 McCrink et al.
2008/0129044 A1 6/2008 Carcagno et al.
2008/0219878 A1 9/2008 Konda et al.
2008/0226396 A1 9/2008 Garcia et al.
2008/0226491 A1 9/2008 Satou et al.
2008/0264129 A1 10/2008 Cheppe et al.
2008/0303274 A1 12/2008 Mazzaferro et al.
2008/0314481 A1 12/2008 Garcia et al.
2009/0010794 A1 1/2009 Turconi et al.
2009/0033087 A1 * 2/2009 Carcagno et al. .... E21B 17/042 285/55
2009/0047166 A1 2/2009 Tomomatsu et al.
2009/0101242 A1 4/2009 Lopez et al.
2010/0136363 A1 6/2010 Valdez et al.
2010/0172717 A1 * 7/2010 Corbett ..... F16B 29/00 411/366.1
2010/0181727 A1 7/2010 Santi et al.
2010/0181761 A1 7/2010 Santi et al.
2010/0187808 A1 7/2010 Santi
2010/0193085 A1 8/2010 Garcia
2010/0206553 A1 8/2010 Bailey et al.
2010/0294401 A1 11/2010 Gomez
2010/0319814 A1 12/2010 Perez
2010/0327550 A1 12/2010 Lopez
2011/0008101 A1 1/2011 Santi et al.
2011/0041581 A1 2/2011 Santi
2011/0042946 A1 2/2011 Santi
2011/0077089 A1 * 3/2011 Hirai ..... B60B 27/0005 464/139
2011/0097235 A1 4/2011 Turconi et al.
2011/0133449 A1 6/2011 Mazzaferro
2011/0233925 A1 9/2011 Pina
2011/0233926 A1 9/2011 Carcagno
2011/0247733 A1 10/2011 Arai et al.
2011/0259482 A1 10/2011 Peters et al.
2011/0284137 A1 11/2011 Kami et al.
2012/0032435 A1 2/2012 Carcagno
2012/0199255 A1 8/2012 Anelli
2012/0204994 A1 8/2012 Anelli
2012/0211132 A1 8/2012 Altschuler
2013/0264123 A1 10/2013 Altschuler
2014/0021244 A1 1/2014 DuBois
2014/0027497 A1 1/2014 Rowland et al.
2014/0272448 A1 9/2014 Valdez et al.

(56) References Cited

U.S. PATENT DOCUMENTS

| | | | | |
|---|---|---|---|---|
| 2014/0299235 | A1 | 10/2014 | Anelli | |
| 2014/0299236 | A1 | 10/2014 | Anelli | |
| 2015/0061287 | A1* | 3/2015 | Yoshikawa | E21B 17/042 285/334 |
| 2015/0368986 | A1 | 12/2015 | Narikawa | |
| 2016/0024625 | A1 | 1/2016 | Valdez | |
| 2016/0102856 | A1 | 4/2016 | Minami | |

FOREIGN PATENT DOCUMENTS

| | | | |
|---|---|---|---|
| CA | 2319926 | | 7/2008 |
| CN | 1401809 | | 3/2003 |
| CN | 1487112 | | 4/2004 |
| CN | 101480671 | | 7/2009 |
| CN | 101542002 | | 9/2009 |
| CN | 101613829 | A | 12/2009 |
| CN | 101413089 | | 11/2010 |
| DE | 3310226 | A1 | 10/1984 |
| DE | 4446806 | | 5/1996 |
| EA | 010037 | | 6/2008 |
| EA | 012256 | | 8/2009 |
| EP | 0 032 265 | | 7/1981 |
| EP | 0 092 815 | | 11/1983 |
| EP | 0 104 720 | | 4/1984 |
| EP | 0 159 385 | | 10/1985 |
| EP | 0 309 179 | | 3/1989 |
| EP | 0 340 385 | | 11/1989 |
| EP | 0 329 990 | | 11/1992 |
| EP | 0 658 632 | | 6/1995 |
| EP | 0 753 595 | | 1/1997 |
| EP | 0 788 850 | | 8/1997 |
| EP | 0 828 007 | | 3/1998 |
| EP | 0 989 196 | | 3/2000 |
| EP | 1 008 660 | | 6/2000 |
| EP | 01 027 944 | | 8/2000 |
| EP | 1 065 423 | | 1/2001 |
| EP | 1 277 848 | | 1/2003 |
| EP | 1 288 316 | | 3/2003 |
| EP | 1 296 088 | | 3/2003 |
| EP | 1 362977 | | 11/2003 |
| EP | 1 413 639 | | 4/2004 |
| EP | 1 705 415 | | 9/2006 |
| EP | 1 717 324 | | 11/2006 |
| EP | 1 726 861 | | 11/2006 |
| EP | 1 914 324 | | 4/2008 |
| EP | 1554518 | B1 | 1/2009 |
| EP | 2 028 284 | | 2/2009 |
| EP | 2 133 442 | | 12/2009 |
| EP | 2 216 576 | A1 | 8/2010 |
| EP | 2 239 343 | | 10/2010 |
| EP | 2325435 | | 10/2012 |
| FR | 1 149 513 | A | 12/1957 |
| FR | 2 704 042 | A | 10/1994 |
| FR | 2 848 282 | A1 | 6/2004 |
| FR | 2855587 | | 12/2004 |
| GB | 498 472 | | 1/1939 |
| GB | 1 398 214 | | 6/1973 |
| GB | 1 428 433 | | 3/1976 |
| GB | 2 104 919 | A | 3/1983 |
| GB | 2 234 308 | A | 1/1991 |
| GB | 2 276 647 | | 10/1994 |
| GB | 2 388 169 | A | 11/2003 |
| JP | 58-187684 | | 12/1983 |
| JP | 60-086209 | | 5/1985 |
| JP | S 60 116796 | A | 6/1985 |
| JP | 60-215719 | A | 10/1985 |
| JP | 36025719 | | 10/1985 |
| JP | S61-103061 | | 5/1986 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | H06-042645 | | 2/1994 |
| JP | 06-093339 | | 4/1994 |
| JP | 06 172859 | A2 | 6/1994 |
| JP | 06-220536 | | 8/1994 |
| JP | 07 041856 | A2 | 2/1995 |
| JP | 07-139666 | | 5/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 2704042 | | 10/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-178645 | | 6/2000 |
| JP | 2000-248337 | A | 9/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2002-130554 | | 5/2002 |
| JP | 2003-074763 | | 3/2003 |
| JP | 2004-011009 | | 1/2004 |
| JP | 60 174822 | | 9/2005 |
| KR | 0245031 | | 3/2000 |
| KZ | 1418 | B | 12/1994 |
| KZ | 2506 | B | 9/1995 |
| KZ | 2673 | B | 12/1995 |
| UA | 51138 | A | 11/2002 |
| WO | WO 1984/002947 | | 8/1984 |
| WO | WO 1994/29627 | | 12/1994 |
| WO | WO 1996/22396 | | 7/1996 |
| WO | WO 2000/06931 | | 2/2000 |
| WO | WO 2000/70107 | | 11/2000 |
| WO | WO 2001/075345 | | 10/2001 |
| WO | WO 2001/88210 | | 11/2001 |
| WO | WO 2002/29290 | | 4/2002 |
| WO | WO 2002/035128 | | 5/2002 |
| WO | WO 2002/068854 | | 9/2002 |
| WO | WO 2002/086369 | | 10/2002 |
| WO | WO 2002/093045 | | 11/2002 |
| WO | WO 2003/033856 | | 4/2003 |
| WO | WO 2003/048623 | | 6/2003 |
| WO | WO 2003/060198 | | 7/2003 |
| WO | WO 2003/087646 | | 10/2003 |
| WO | WO 2004/023020 | | 3/2004 |
| WO | WO 2004/031420 | | 4/2004 |
| WO | WO 2004/033951 | | 4/2004 |
| WO | WO 2004/053376 | | 6/2004 |
| WO | WO 2004/097059 | | 11/2004 |
| WO | WO 2004/109173 | | 12/2004 |
| WO | WO 2005/098300 | | 10/2005 |
| WO | WO 2006/087361 | | 4/2006 |
| WO | WO 2006/078768 | | 7/2006 |
| WO | WO 2007/002576 | | 1/2007 |
| WO | WO 2007/017082 | | 2/2007 |
| WO | WO 2007/017161 | | 2/2007 |
| WO | WO 2007/026970 | | 3/2007 |
| WO | WO 2007/028443 | | 3/2007 |
| WO | WO 2007/034063 | | 3/2007 |
| WO | WO 2007/063079 | | 6/2007 |
| WO | WO 2008/003000 | | 1/2008 |
| WO | WO 2008/090411 | | 7/2008 |
| WO | WO 2008/108263 | | 9/2008 |
| WO | WO 2008/110494 | | 9/2008 |

(56) References Cited

FOREIGN PATENT DOCUMENTS

| | | |
|---|---|---|
| WO | WO 2008/127084 | 10/2008 |
| WO | WO 2009/000851 | 12/2008 |
| WO | WO 2009/000766 | 1/2009 |
| WO | WO 2009/010507 | 1/2009 |
| WO | WO 2009/027308 | 3/2009 |
| WO | WO 2009/027309 | 3/2009 |
| WO | WO 2009/044297 | 4/2009 |
| WO | WO 2009/065432 | 5/2009 |
| WO | WO 2009/106623 | 9/2009 |
| WO | WO 2010/061882 | 6/2010 |
| WO | WO 2010/122431 | 10/2010 |
| WO | WO 2013/007729 | 1/2013 |

OTHER PUBLICATIONS

Kazutoshi Ohashi et al, "Evaluation of r-value of steels using Vickers hardness test", Journal of Physics: Conference Series, Aug. 7, 2012, p. 12045, vol. 379, No. 1, Institute of Physics Publishing, Bristol, GB.

International Search Report for International Application No. PCT/IB2013/050265, dated Oct. 28, 2013.

"Specifications for Threading, Gauging and Thread Inspection of Casing, Tubing, and Line Pipe Threads," American Petroleum Institute, Specification 5B, Apr. 2008, 15th Edition (Excerpts Only).

Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.

Extrait du Catalogue N 940, 1994.

"Seamless Steel Tubes for Pressure Purposes—Technical Delivery Conditions—Part 1: Non-alloy Steel Tubes with Specified Room Temperature Properties" British Standard BS EN 10216-1:2002 E:1-26, published May 2002.

"Seamless Steel Tubes for Pressure Purposes—Technical Delivery Conditions—Part 2: Non-alloy and Alloy Steel Tubes with Specified Elevated Temperature Properties" British Standard BS EN 10216-2:2002+A2:2007:E:1-45, published Aug. 2007.

"Seamless Steel Tubes for Pressure Purposes—Technical Delivery Conditions—Part 3: Alloy Fine Grain Steel Tubes" British Standard BS EN 10216-3:2002 +A1:2004 E:1-34, published Mar. 2004.

"Seamless Steel Tubes for Pressure Purposes—Technical Delivery Conditions—Part 4: Non-alloy and Alloy Steel Tubes with Specified Low Temperature Properties" British Standard BS EN 10216-4:2002 + A1:2004 E:1-30, published Mar. 2004.

Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.

Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.

Asahi, et al., Development of Ultra-high-strength Linepipe, X120, Nippon Steel Technical Report, Jul. 2004, Issue 90, pp. 82-87.

ASM Handbook, Mechanical Tubing and Cold Finishing, Metals Handbook Desk Edition, (2000), 5 pages.

ASTM A 213/A 213M "Standard Specification for Seamless Ferritic and Austenitic Alloy-Steel Boiler, Superheater, and Heat-Exchanger Tubes".

ASTM A182/A182M "Standard Specification for Forged or Rolled Alloy and Stainless Steel Pipe Flanges, Forged Fittings, and Valves and Parts for High-Temperature Service".

ASTM A336/A336M "Standard Specification for Alloy Steel Forgings for Pressure and High-Temperature Parts".

ASTM A355 which is related to "Seamless Ferritic Alloy—Steel Pipe for High-Temperature Service".

Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.

Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.

Berner, Robert A., "Tetragonal Iron Sulfide", Science, Aug. 31, 1962, vol. 137, Issue 3531, pp. 669.

Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.

Boulegue, Jacques, "Equilibria in a sulfide rich water from Enghien-les-Bains, France", Geochimica et Cosmochimica Acta, Pergamon Press, 1977, vol. 41, pp. 1751-1758, Great Britain.

Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.

Cancio et al., "Characterization of microalloy precipitates in the austenitic range of high strength low alloy steels", Steel Research, 2002, vol. 73, pp. 340-346.

Carboni, A., A. Pigani, G. Megahed, S. Paul, "Casting and rolling of API X 70 grades for artic application in a thin slab rolling plant", Stahl u Eisen, 2008, N° 1, p. 131-134.

Chitwood, G. B., et al.: "High-Strength Coiled Tubing Expands Service Capabilities", as presented at the 24th Annual OTC in Houston, Texas, May 4-7, 1992, in 15 pages.

Clark, A. Horrell, "Some Comments on the Composition and Stability Relations of Mackinawite", Neues Jahrbuch fur Mineralogie, 1966, vol. 5, pp. 300-304, London, England.

Craig, Bruce D., "Effect of Copper on the Protectiveness of Iron Sulfide Films", Corrosion, National Association of Corrosion Engineers, 1984, vol. 40, Issue 9, pp. 471-474.

D.O.T. 178.68 Spec. 39, pp. 831-840, Non reusable (non refillable) cylinders, Oct. 1, 2002.

Davis, J.R., et al. "ASM—Speciality Handbook—Carbon and alloy steels" ASM Speciality Handbook, Carbon and Alloy Steels, 1996, pp. 12-27, XP002364757 US.

De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.

Drill Rod Joint Depth Capacity Chart, downloaded Jan. 15, 2013; http://www.boartlongyear.com/drill-rod-joint-depth-capacity-chart.

Echaniz, "The effect of microstructure on the KISSC of low alloy carbon steels", NACE Corrosion '98, EE. UU., Mar. 1998, pp. 22-27, San Diego.

Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.

Fang, Hong-Sheng, et al.: "The Developing Prospect of Air-cooled Bainitic Steels", International Journal of Issi, vol. 2, No. 2, Feb. 1, 2005, pp. 9-18.

Fratini et al.: "Improving friction stir welding of blanks of different thicknesses," Materials Science and Engineering A 459 (2007).

Gojic, Mirko and Kosec, Ladislav, , "The Susceptibility to the Hydrogen Embrittlement of Low Alloy Cr and CrMo Steels", ISIJ International, 1997, vol. 37, Issue 4, pp. 412-418.

Gomez, G., et al.: "Air cooled bainitic steels for strong, seamless pipes—Part 1—allowy design, kinetics and microstructure", Materials Science and Technology, vol. 25, No. 12, Dec. 1, 2009. (XP002611498).

Heckmann, et al., Development of low carbon Nb—Ti—B microalloyed steels for high strength large diameter linepipe, Ironmaking and Steelmaking, 2005, vol. 32, Issue 4, pp. 337-341.

Hollomon, J.H., et al., Time-tempered Relations in Tempering Steel. New York Meeting, pp. 223-249, 1945.

(56) References Cited

OTHER PUBLICATIONS

Howells, et al.: "Challenges for Ultra-Deep Water Riser Systems", IIR, London, Apr. 1997, 11 pages.
Hutchings et al., "Ratio of Specimen thickness to charging area for reliable hydrogen permeation measurement", British Corrosion. Journal, 1993, vol. 28, Issue 4, pp. 309-312.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
ISO. Petroleum and natural gas industries—Materials for use in H2Scontaining environments in oil and gas production. ANSI/NACE ISO, 145 pages, 2009.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.
Keizer, Joel, "Statistical Thermodynamics of Nonequilibrium Processes", Springer-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mehling, Wilfred L.: "Hot Upset Forging," ASM Handbook vol. 14, 1998, pp. 84-95.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Möessbauer Studies of Iron Sulfides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochimica et Cosmochimica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
NACE MR0175/ISO 15156-1 Petroleum and natural gas industries—Materials for use in H2S-containing Environments in oil and gas production—Part 1: General principles for selection of cracking-resistant materials, Jun. 28, 2007.
Nagata, M., J. Speer, D. Matlock, "Titanium nitride precipitation behavior in thin slab cast high strength low alloyed steels", Metallurgical and Materials Transactions A, 2002 , vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Nandan et al.: "Recent advances in friction-stir welding—Process, weldment structure and properties," Progress in Materials Science 53 (2008) 980-1023.
Pollack, Herman, W., Materials Science and Metallurgy, Fourth Edition, pp. 96 and 97, 1988.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Temperatures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde.., 1984, vol. 75, pp. 76-81.
Savatori et al.: European Commssion Report, EUR 2006, EUR2207, 3 pp. STN_Abstract.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.
Smyth, D., et al.: Steel Tubular Products, Properties and Selection: Irons, Steels, and High-Performance Alloys, vol. 1, ASM Handbook, ASM International, 1990, p. 327-336.
Spry, Alan, "Metamorphic Textures", Perganon Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris brochure. Coiled Tubes HS80CRA, 2 pages, 2008.
Tenaris brochure. Coiled Tubes Suggested Field Welding Procedure (GTAW) for Coiled Tubing Grads HS70, HS80, HS90, HS11 0, 3 pages, 2007.
Tenaris brochure. Coiled Tubing for Downhole Applications, 10 pages, 2007.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall—High Strength Seamless Pipes for Deep Water Applications", RioPipeline 2005, Oct. 17-19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe—Cr—Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstructure and precipitation control"; "Paper 01077", NACE International, Houston, TX, Mar. 16, 2001. (XP009141583).
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
Yu et al.: "New steels and alloys in mechanical engineering / ed.," M: Mechanical Engineering, 1976, p. 19.

* cited by examiner

GALLING RESISTANT DRILL PIPE TOOL JOINT AND CORRESPONDING DRILL PIPE

TECHNICAL FIELD

This invention relates to a drill pipe tool joint and a corresponding drill pipe, more particularly, to a drill pipe tool joint and a corresponding drill pipe, which has optimized surface hardness for repeating make-up/break-out operation without the use of a screw grease when drill pipes used in well drilling for oil, natural gas, shale gas, geothermal and the like are screwed together, thereby being environment-friendly, as well as improving operating efficiency.

BACKGROUND ART

Drill pipes used in drilling wells for oil, natural gas, and the like have been connected by tool joints. In order for the tool joints to transmit high torque required during drilling, an outer diameter portion thereof is formed to be greater than an outer diameter of a pipe body, while an inner diameter portion thereof is formed to be smaller than an inner diameter of the pipe body. To this end, generally, a make-up torque value during joining a pin and a box of the tool joints is required to be several times a make-up torque value for casing or tubing used in wells for production of oil, natural gas, and the like.

On the other hand, for the number of times of make-up/break-out operations of the pin and the box of the threaded joints for the casing or tubing used in wells for production, the number of tripings is not so many. Therefore, for anti-galling (scoring) evaluation testing, International Organization for Standardization standard ISO13679 defines acceptance/rejection determination in performance evaluation for 2 times of make-up/break-out operation in the casing and for 9 times of make-up/break-out operation in the tubing. However, the drill pipes require drill bit replacement according to drilling conditions of each type such as geological strata, well inclination, depth, and the like. Further, there is no ISO standard definition for the drill pipes, but the galling resistance is expected to be not less than 25 trips, and more preferably not less than 50 trips.

For the casing or tubing, a lubricating grease (or dope) to be applied to the pin and the box of the threaded joints has been used for anti-galling, and also a surface treatment such as plating has been employed (see here bellow patent literatures 1 to 7). However, spreading due to tool joint cleaning, excess lubricating grease deposition on well bottom due to coating, rig pollution emission in workplace, etc. may have adverse effects on the environment. Therefore, for environmental consideration, alternative surface coating treatment using no conventional screw lubricating grease, so-called "grease-free" or "dope-free", i.e., with no lubricating grease (nor dope) to be applied to the pin and the box of the threaded joints, has recently been put into practical use.

Following documents have been identified that relate to the said technical field:

PATENT LITERATURE CITATION LIST

Patent Literature 1: WO2003-060198
Patent Literature 2: WO2005-098300
Patent Literature 3: WO2007-026970
Patent Literature 4: WO2008-108263
Patent Literature 5: JP-A-2003-074763

Patent Literature 6: U.S. Pat. No. 4,758,025
Patent Literature 7: U.S. Pat. No. 4,468,309

Patent Literature 1 discloses a tubular member in which at least one of a pin and a box is coated with an alloy of copper and tin which contains 20 wt % to 80 wt % copper.

Patent Literature 2 discloses a threaded joint for steel pipes in which at least one of a pin and a box is furnished with a solid lubricant coating comprising a binder, copper powder and lubricating powder at its surface and the other of the pin and the box is coated with zinc or zinc alloy coating.

Patent Literature 3 discloses a threaded joint for steel pipes in which Sn—Bi alloy plating or Sn—Bi—Cu alloy plating is formed on at least one of a pin and a box.

Patent Literature 4 discloses a screw joint for steel pipe in which at least one of a pin and a box is covered with a first plating layer of Cu—Zn alloy or Cu—Zn-M1 alloy (M1 is at least one selected from among Sn, Bi and In), and a second plating layer of Sn-M2 alloy (M2 is at least one element selected from among Bi, In, Ni, Zn and Cu).

Patent Literature 5 discloses a joint for an oil well pipe in which a first plating layer comprising the first to the nth layers of Cu—Sn alloy plating is formed on a box.

Patent Literature 6 discloses a method for preventing galling comprising providing a soft metal coating such as an electroless metal conversion coating of Cu or Zn on at least one of a pin and a box, and coating a lubricant agent thereon.

Patent Literature 7 discloses a method for resisting galling including depositing a material film having a low shear stress value such as gold, silver, lead, tin, indium, palladium or copper by ion plating on at least one of a pin and a box.

Although Patent Literatures 1 to 7 disclose examples of solid lubricant, a technique for achieving repetitive make-up/break-out operations of a drill pipe tool joint for not less than 25 times without any use of a lubricating grease has not been found.

SUMMARY OF INVENTION

Technical Problem

However, as it stands, there exists no substitutable surface coating treatment using no screw lubricating grease for the drill pipe tool joints.

There is furthermore a constant need of improving galling resistance and achieving an increasing number of repetitive make-up/break-out operations of a drill pipe tool joint.

Accordingly, it is an object of the present invention to provide a drill pipe tool joint and a corresponding drill pipe, which can be subject to repetitive make-up/break-out operations for not less than 25 times without any use of a lubricating grease for avoiding galling, which is environment-friendly, and which does not use a lubricant.

Solution to Problem

The said technical problem is solved thanks to a drill pipe tool joint comprising: a pin including a male threaded portion at an outer surface; and a box including a female threaded portion at an inner surface, the female threaded portion to be screwed and fastened to the male threaded portion in a contacting zone consisting of a male threaded contacting surface and a female threaded contacting surface, wherein at least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and where said both surface portions are contacting surfaces after screwing.

The present invention is also directed to a drill pipe comprising:

a pipe body; and a pin including a male threaded portion at an outer surface; and a box including a female threaded portion at an inner surface, the female threaded portion to be screwed and fastened to a male threaded portion of another drill pipe of the same kind, in a contacting zone consisting of a male threaded contacting surface and a female threaded contacting surface;

wherein at least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and where said both surface portions are contacting surfaces after screwing.

A plurality of said drill pipes will comprise, after being assembled, a plurality of preceding drill pipe tool joints.

Therefore the said drill pipe tool joint and drill pipe relate to a group of inventions so linked as to form a single general inventive concept.

The drill pipe tool joint or the drill pipe according to the present invention may also comprise following features that may be combined according to all possible embodiments:

the surface layers consisting respectively of a hard metal and of a soft material occupy at least 90% of the contacting zone surfaces;

the male threaded contacting surface or the female threaded contacting surface is a surface layer consisting of a hard metal and respectively the female threaded contacting surface or the male threaded contacting surface is a surface layer consisting of a soft material;

the hardness of the hard metal is equal or greater than 600 Hv, for example equal or greater than 800 Hv;

the hardness of the soft material is equal or lower than 350 Hv, for example equal or greater than 150 Hv;

the hardness ratio of the hard metal to the soft material is equal or greater than 2.8, for example equal or greater than 5;

the hard metal substantially consists of a metal chosen within the list consisting of chromium (Cr), nickel (Ni), or their mixture; according to an embodiment, said layer of hard metal is obtained through a plating process; according to an embodiment, the layer of hard metal is made of hard chromium plating; according to another embodiment, the layer of hard metal is made non electric nickel plating;

the thickness of the layer of hard metal is comprised between 5 to 100 μm, for example equal or greater than 10 μm, for example equal or less than 50 μm;

the soft material consists of a metal chosen within the list consisting of copper (Cu), zinc, (Zn), or their mixture; according to an embodiment, said layer of soft material is obtained through a plating process; according to an embodiment, the layer of soft material is made of electrolytic copper or of electrolytic zinc;

the soft material substantially consists of a phosphate layer;

the thickness of the layer of soft material is comprised between 5 to 100 μm, for example equal or greater than 10 μm, for example equal or less than 50 μm;

the drill pipe tool joint is devoid of dope or of lubricant grease;

the pin including the male threaded portion and the box including the female threaded portion are devoid of dope or of lubricant grease when being screwed and fastened for assembling.

According to the present invention the hardness of a layer is determined as Vickers hardness (Hv).

According to the present invention, one has to understand the wordings "hard" and "soft" as relative wordings; a surface layer consisting of a soft material has thus hardness lower than a surface layer consisting of a hard material.

The present invention also relates to a method of assembling preceding drill pipes wherein the pins including the male threaded portion and the boxes including the female threaded portion are devoid of dope or of lubricant grease when being screwed and fastened for assembling.

Advantageous Effects of Invention

According to the invention, it is possible to provide a drill pipe tool joint and a corresponding drill pipe, which can be subject to repetitive make-up/break-out operations for not less than 25 times without any use of lubricating grease for suppressing galling, which is environment-friendly, and which does not use a lubricant.

DESCRIPTION OF EMBODIMENTS

Structure of Drill Pipe Tool Joint

Figure 1:
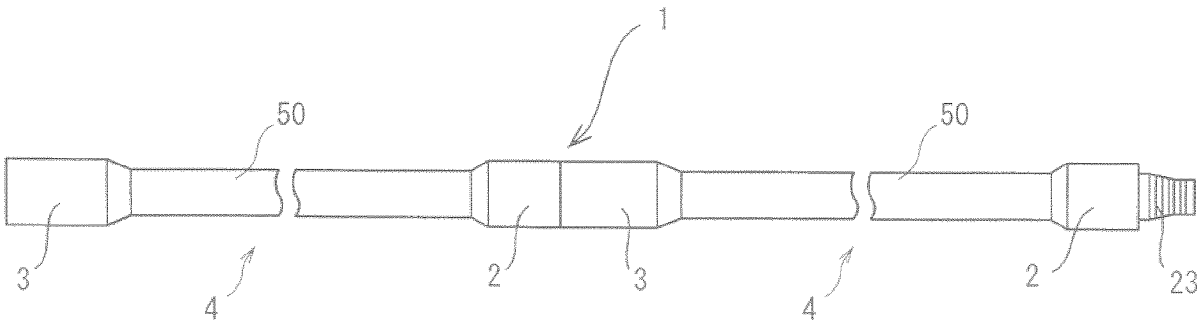
FIG. 1 is a diagram showing a whole structure of a drill pipe tool joint and a drill pipe with that drill pipe tool joint in an embodiment according to the invention.
Figure 2:
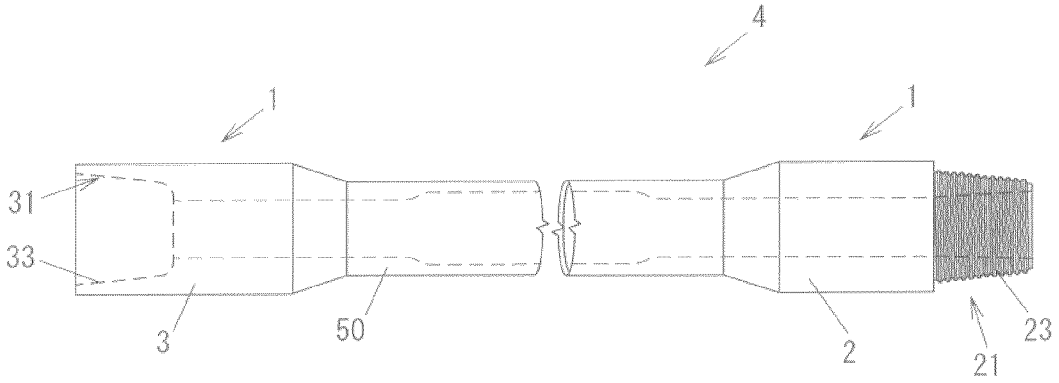
FIG. 2 is a longitudinal cross-sectional view showing the drill pipe in the embodiment according to the invention.

FIG. 1 is a diagram showing a whole structure of a drill pipe tool joint and a drill pipe with that drill pipe tool joint, in an embodiment according to the invention. In addition, FIG. 2 is a longitudinal cross-sectional view showing the drill pipe in the embodiment according to the invention. The drill pipe tool joint for drilling is defined by the API (American Petroleum Institute) standard, and is formed in several shapes with different details, such as a shape as shown in FIGS. 1 and 2.

A drill pipe tool joint 1 in an embodiment according to the invention comprises a pin 2 including a male threaded portion 23 at an outer surface 21, a box 3 including a female threaded portion 33 at an inner surface 31. The female threaded portion 33 is to be screwed and fastened to the male threaded portion 23 in a contacting zone consisting of a male threaded contacting surface and a female threaded contacting surface. At least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and said both surface portions are contacting surfaces after screwing.

Namely, the screwed surface (21 or 31) of the one of the male threaded portion 23 and the female threaded portion 33 includes a surface layer consisting of a hard metal, while the screwed surface (31 or 21) of the other thereof includes a surface layer consisting of a soft material which is lower in hardness than the surface layer consisting of a hard metal.

More concretely, the screwed surface (21 or 31) of the one of the male threaded portion 23 and the female threaded portion 33 has a layer or structure having a first hardness as an outermost surface entirely around the screwed surface thereof, while the screwed surface (31 or 21) of the other thereof has a layer or structure having a second hardness as an outermost surface entirely around the screwed surface thereof, in which the second hardness is lower in hardness than the first hardness.

A drill pipe 4 in another embodiment according to the invention comprises a pipe body 50, a pin 2 including a male threaded portion 23 at an outer surface 21 and a box 3 including a female threaded portion 33 at an inner surface 31. The female threaded portion is to be screwed and fastened to a male threaded portion of another drill pipe of the same kind, in a contacting zone consisting of a male threaded contacting surface and a female threaded contacting surface. At least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and said both surface portions are contacting surfaces after screwing.

The drill pipe 4 is used in drilling by fastening (referred to as "make-up") and connecting a plurality of drill pipes 4 with the drill pipe tool joints 1. Here, the drill pipe tool joint 1 comprises the male threaded portion 23 provided at the outer surface 21 of the pin 2 of the drill pipe 4, and the female threaded portion 33 provided at the inner surface 31 of the box 3 of the other drill pipe 4. The male threaded portion 23 provided at the outer surface 21 of the pin 2 of the drill pipe 4 and the female threaded portion 33 provided at the inner surface 31 of the box 3 of the other drill pipe 4 are screwed and fastened together. In addition, the drill pipes 4 are unfastened (referred to as "break-out") as necessity. Therefore, the drill pipes 4 are subject to repetitive make-up/break-out operations at the drill pipe tool joint 1.

The male threaded portion 23 formed at the outer surface 21 of the pin 2 includes the surface layer consisting of a hard metal having the first hardness (i.e. hard surface-treated surface), or the surface layer consisting of a soft material having the second hardness provided by a surface layer consisting of a soft material (i.e. soft surface-treated surface), in which the second hardness is lower in hardness than the first hardness.

As examples of the hard metal, there are listed chromium plating, hard chromium plating, nickel plating, non-electric nickel plating, etc.

Also, as examples of the surface layer consisting of a soft material at the lower hardness than the hard metal surface treatment described above, there are listed a copper plating, electrolytic copper plating, zinc plating, electrolytic zinc plating, etc. Further, surface layer consisting of a soft material is not limited to the plating, but a phosphating such as manganese phosphating and zinc phosphating may be employed, namely a phosphate layer may be formed.

According to embodiments of the present invention, the hardness of the hard metal is equal or greater than 600 Hv, for example equal or greater than 800 Hv.

According to embodiments of the present invention, the hardness of the soft material is equal or lower than 350 Hv, for example equal or greater than 150 Hv.

According to embodiments of the present invention, the thickness of the layer of hard metal is comprised between 5 to 100 μm, for example equal or greater than 10 μm, for example equal or less than 50 μm.

According to embodiments of the present invention, the thickness of the layer of soft material is comprised between 5 to 100 μm, for example equal or greater than 10 μm, for example equal or less than 50 μm.

On the other hand, the female threaded portion 33 formed at the inner surface 31 of the box 3 has a surface-treated surface which is surface-treated differently from the surface-treated surface of the male threaded portion 23. More concretely, the female treaded portion 33 has a layer or a structure (including metal structure) having the second hardness at its outermost surface. When the male threaded portion 23 has the surface-treated surface having the first hardness, the female threaded portion 33 has the surface-treated surface having the second hardness, which is lower in hardness than the first hardness (i.e. soft surface-treated surface). Alternatively, when the male threaded portion 23 has the surface-treated surface having the second hardness, the female threaded portion 33 has the surface-treated surface having the first hardness.

The drill pipes 4 with the male threaded portion 23 and the female threaded portion 33 configured as described above are fastened together with the drill pipe tool joint 1. In other words, the drill pipes 4 are fastened together by screwing the male threaded portion 23 to the female threaded portion 33.

The male threaded portion 23 has a surface layer consisting of a soft material or a surface layer consisting of a hard metal as described above, and the female threaded portion 33 has a surface layer consisting of a hard metal or a surface layer consisting of a soft material described above. More concretely, when the male threaded portion 23 has a surface layer consisting of a hard metal, the female threaded portion 33 has a surface layer consisting of a soft material. Alternatively, when the male threaded portion 23 has a surface layer consisting of a soft material, the female threaded portion 33 has a surface layer consisting of a hard metal.

In the drill pipe tool joint 1, the male threaded contacting surface or the female threaded contacting surface is a surface layer consisting of a hard metal and respectively the female threaded contacting surface or the male threaded contacting surface is a surface layer consisting of a soft material.

Other embodiments within the scope of the present invention may have contacting zone surfaces with surface layers consisting of a hard metal and/or of a soft material occupying only partially the contacting zone surfaces; according to an embodiment, the surface layers consisting respectively of a hard metal and of a soft material occupy at least 90% of the contacting zone surfaces.

In the drill pipe tool joint 1 thus configured, even though the make-up/break-out operation is repeatedly performed between the female threaded portion 33 and the male threaded portion 23, the occurrence of so-called "galling" is suppressed. Therefore, the number of times of make-up/break-out operation until the occurrence of galling can be increased.

Here, the "galling" represents the state of the damage caused by the contact between the metals. The "advance to galling from seizure (welding)" refers to a state that a contact surface is seized and does not move at the initial seizure then further rotated or moved so that the seized surface exfoliates and is damaged. This galling is likely to occur in the case that a contact surface pressure is high or that an affinity between rubbing metals is high.

In the present embodiment, the male threaded portion 23 and the female threaded portion 33 have the surface layer consisting of a hard metal and the surface layer consisting of a soft material that are different in hardness from each other, respectively, so that the affinity between surfaces to be in contact with each other is low. Further, it is preferable to set a hardness ratio of the hard metal to the soft material to be not less than 2.8 as described later. According to an embodiment said hardness ratio of the hard metal to the soft material equal or greater than 5. According to this structure, it is possible to suppress the occurrence of galling, thereby increase the number of times of make-up/break-out operations until the occurrence of galling. It should be noted that the number of times of make-up/break-out operations of the drill pipe tool joint 1 is demanded strictly compared with those of conventional threaded tool joint for a casing and tubing for wells for production, so that the number of times of make-up/break-out operations is preferably not less than 25 times, more preferably not less than 50 times.

EXAMPLES

Make-Up/Break-Out Testing

In order to carry out an anti-galling evaluation in make-up/break-out operation of the drill pipe tool joint 1, a make-up/break-out testing was conducted by using a drill pipe with a size of 5½ FH. The drill pipe of 5½ FH has an outer diameter of 7 inches (177.8 mm) and an inner diameter of 3.75 inch (95.25 mm). Material grade is TJ130 (AISI modified 4135, Yield strength 130-150 ksi, Tensile strength Min. 140 ksi). Surface treatment area is from corner of the external shoulder through threads to the internal shoulder or internal bevel. After repeating make-up/break-out operations of the drill pipe, the number of times of make-up/break-out operations until the galling occurs at a surface of the male threaded portion 23 or the female threaded portion 33 was evaluated. The evaluation result is preferably not less than 25 times, more preferably not less than 50 times.

Table 1 shows the results of the make-up/break-out testing. The combinations of the surface treatments provided on the surfaces of the male threaded portion 23 and the female threaded portion 33 are as follows: the pin is coated with copper plating, chromium plating, or nickel plating, and the box is provided with copper plating, zinc plating, manganese phosphating, or no surface treatment (i.e. as machined without any surface treatment, which is indicated as "none" in the item of "surface treatment"). The number of times of make-up/break-out operations until the occurrence of galling is evaluated for each of these samples. For the plating thickness, a range of not less than 10 μm and less than 30 μm, which is available for industrial purpose, was selected.

TABLE I

| | Pin | | Box | | | The number of times of make-up/break-out until the |
|---|---|---|---|---|---|---|
| | Surface Treatment | Thickness (μm) | Surface Treatment | Thickness (μm) | Hardness Ratio | occurrence of galling |
| Example 1 | Cr plating | 10-20 | Cu plating | 20-30 | 6.37 | No occurrence of galling even after 100 times of repetitions |
| Example 2 | Ni plating | 10-20 | Cu plating | 20-30 | 6.64 | No occurrence of galling even after 100 times of repetitions |
| Example 3 | Cr plating | 10-20 | Cu plating | 10-20 | 6.37 | 74 times |
| Example 4 | Ni plating | 10-20 | Cu plating | 10-20 | 6.64 | 69 times |
| Example 5 | Cr plating | 10-20 | Zn plating | 10-20 | 9.24 | 64 times |
| Example 6 | Ni plating | 10-20 | Zn plating | 10-20 | 9.64 | 58 times |
| Example 7 | Cr plating | 10-20 | Manganese phosphating | 10-20 | 2.80 | 25 times |
| Example 8 | Cr plating | 10-20 | Manganese phosphating | 10-20 | 2.80 | 26 times |
| Example 9 | Ni plating | 10-20 | Manganese phosphating | 10-20 | 2.92 | 25 times |
| Comparative Example 1 | Cu plating | 10-20 | Cu plating | 10-20 | 1.00 | 1 time |
| Comparative Example 2 | Cu plating | 10-20 | Cu plating | 20-30 | 1.00 | 13 times |

TABLE I-continued

| | Pin | | Box | | | The number of times of make-up/break-out until the |
|---|---|---|---|---|---|---|
| | Surface Treatment | Thickness (μm) | Surface Treatment | Thickness (μm) | Hardness Ratio | occurrence of galling |
| Comparative Example 3 | Cu plating | 10-20 | Manganese phosphating | 10-20 | 2.27 | 1 time |
| Comparative Example 4 | Cu plating | 10-20 | None | 10-20 | 2.50 | 1 time |
| Comparative Example 5 | Cu plating | 20-30 | Cu plating | 10-20 | 1.00 | 15 times |
| Comparative Example 6 | Cu plating | 20-30 | Manganese phosphating | 10-20 | 2.27 | 6 times |
| Comparative Example 7 | Cu plating | 20-30 | None | — | 2.50 | 1 time |
| Comparative Example 8 | Cu plating | 10-20 | None | — | 2.50 | 1 time |

From the results of Table 1, it was found that in the cases that the pin 2 and the box 3 are provided with a surface layer consisting of a hard metal and a surface layer consisting of a soft material that are different from each other, the make-up/break-out operations without any occurrence of galling can be conducted for not less than 25 times, so that the galling resistance is good (in Examples 1 to 9). Particularly, in the cases that the chromium plating or nickel plating is applied to the pin 2 while the copper plating or zinc plating is applied to the box 3, the make-up/break-out operations without any occurrence of galling can be conducted for not less than 50 times (in Examples 1 to 6). The combination of the surface layer consisting of a hard metal and the surface layer consisting of a soft material, more concretely, the combinations of the chromium plating or nickel plating and the copper plating or zinc plating have the interchangeability so that they may be applied on either side to of the box 3 and the pin 2. In Table 1, "Cr plating" is hard Cr plating, "Ni plating" is electroless Ni—P plating, "Cu plating" is electrolytic Cu plating, and "Zn plating" is electrolytic Zn plating.

Hardness Measurement

From the results of the make-up/break-out testing described above, it was found that the galling resistance would be excellent when the pin 2 and the box 3 are provided with the hard surface treatment and soft surface treatment that are different from each other in hardness. Then, the hardness of each of the hard surface treatment and the soft surface treatment was studied as parameter.

Table 2 shows the measurement results of the surface hardness of the surface treatment provided for each of the pin 2 and the box 3, in which the hardness in each of Nos. 1 to 6 according to the type of the surface treatment is shown by Vickers hardness (Hv). The Vickers hardness test method was performed in accordance with ISO 6507-1 and ISO 6507-4. The measurement was carried out for plural times, and an average value thereof is shown as the hardness (average Hv). Further, in the case of plating, the hardness of the plating material itself can be used instead of the measured value as the hardness of each surface treatment. As described above, the type of the surface treatment corresponds to the type of the surface treatment in Examples 1 to 9 and comparative examples 1 to 8 in Table 1.

TABLE 2

| | Type of surface treatment | Hardness (average Hv) |
|---|---|---|
| 1 | Non electric Ni P plating | 877 |
| 2 | Hard Cr plating | 841 |
| 3 | Electrolytic Cu plating | 132 |
| 4 | Electrolytic Zn plating | 91 |
| 5 | Manganese phosphating | 300 |
| 6 | Drill pipe tool joint material as machined | 330 |

The relationship between the hardness ratio of the hard metal to the soft material and the number of times of make-up/break-out operations is now discussed.

Figure 3:
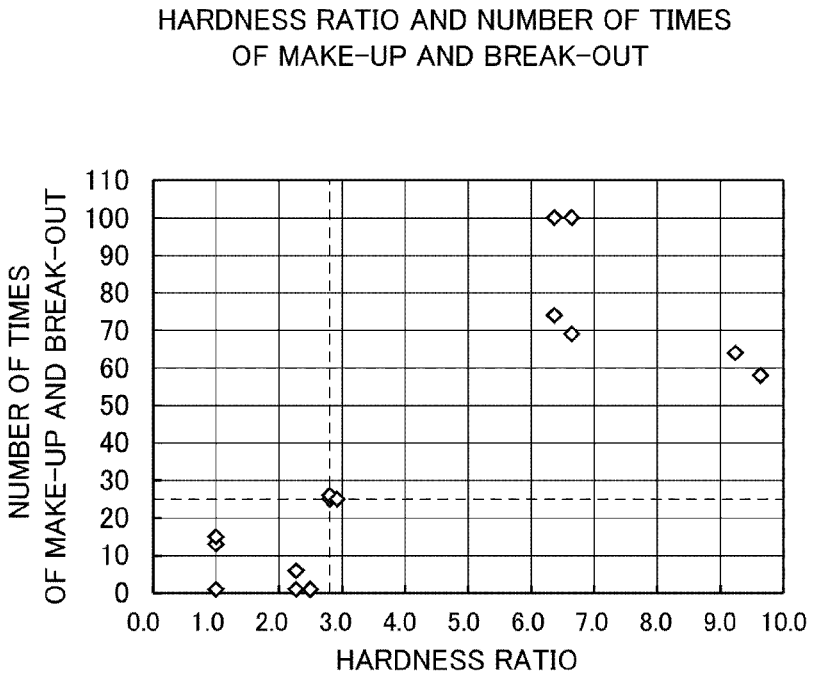
FIG. 3 is a graph showing the relationship between the hardness ratio of the hard metal to the soft material and the number of times of make-up/break-out operation of the drill pipe tool joint in the embodiment according to the invention.

FIG. 3 is a graph showing the relationship between the hardness ratio of the hard metal to the soft material and the number of times of make-up/break-out from the results in Table 1 and Table 2. According to FIG. 3, when the hardness ratio of the hard metal to the soft material is not less than 2.8, the number of times of make-up/break-out operations without any occurrence of galling is increased to be not less than 25 times. Results are furthermore increased when the hardness ratio of the hard metal to the soft material is equal or greater to 5, as for an example equal or greater than 6.

Figure 4A:
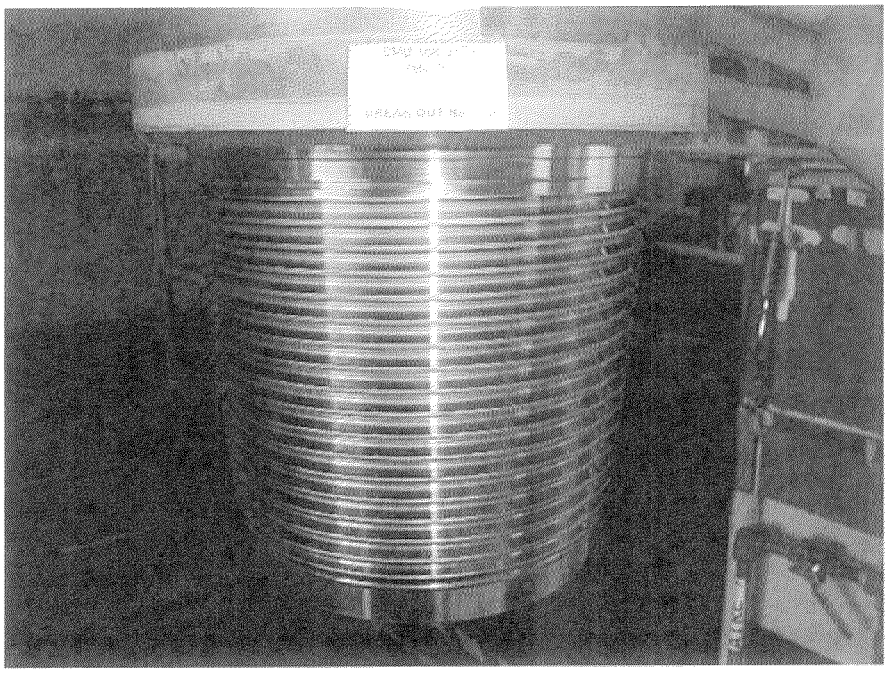
FIG. 4A is a photograph showing a surface state of a pin after make-up/break-out testing for the drill pipe tool joint in the embodiment according to the invention.
Figure 4B:
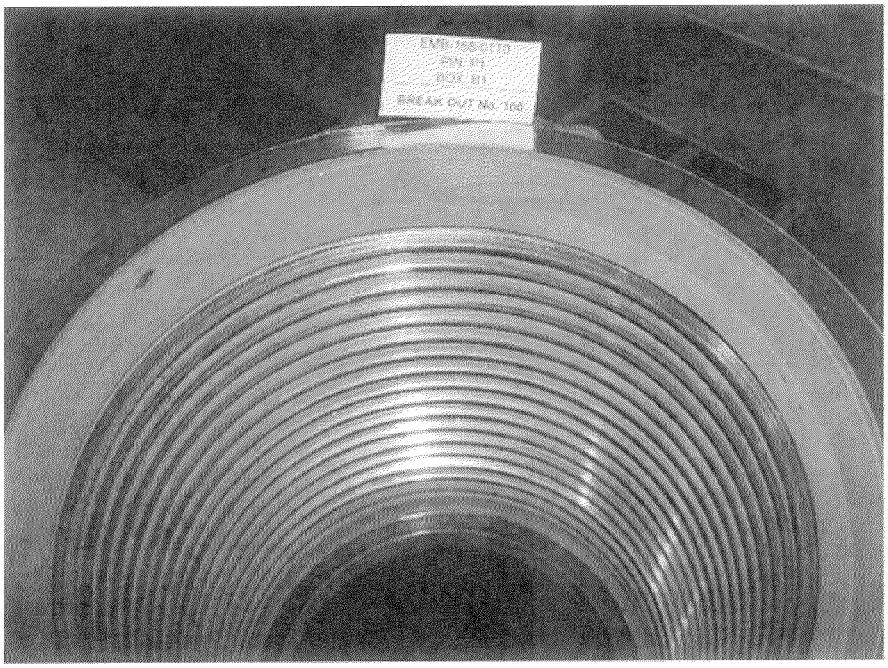
FIG. 4B is a photograph showing a surface state of a box after the make-up/break-out testing for the drill pipe tool joint in the embodiment according to the invention.
Figure 5A:
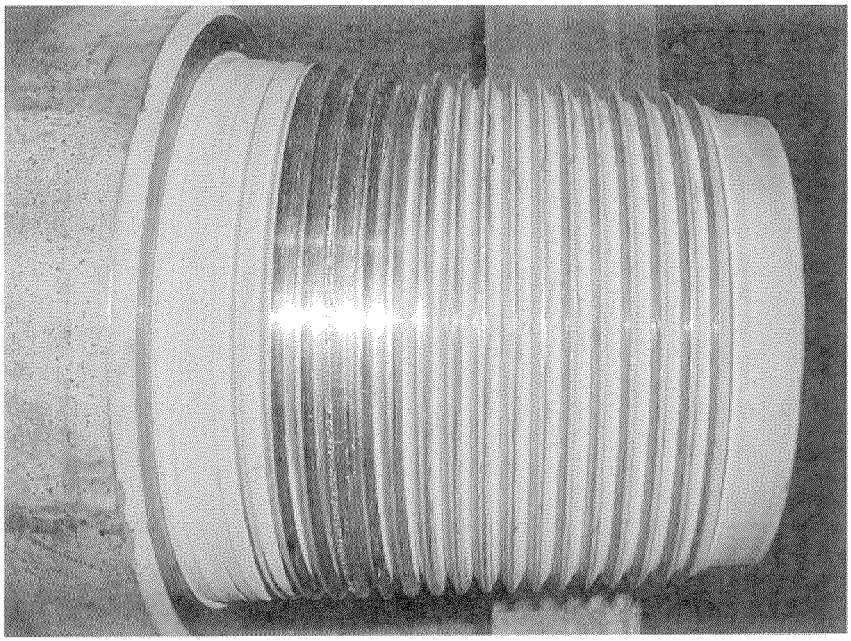
FIG. 5A is a photograph showing a surface state of a pin on which the galling occurred after make-up/break-out testing for a drill pipe tool joint.

FIG. 4A is a photograph showing a surface state of a pin after make-up/break-out testing for the drill pipe tool joint in the embodiment according to the invention, and FIG. 4B is a photograph showing a surface state of a box after the make-up/break-out testing for the drill pipe tool joint in the embodiment according to the invention. FIG. 5A is a photograph showing a surface state of a pin on which the galling occurred after make-up/break-out testing for a drill pipe tool joint, and FIG. 5B is a photograph showing a surface state of a box on which the galling occurred after the make-up/break-out testing for the drill pipe tool joint.

In the make-up/break-out testing as shown in Table 1, no galling occurred at the chromium plated surface of the pin 2 and the copper plated surface of the box 3 even after repeating the make-up/break-out operation for not less than 50 times as shown in FIGS. 4A and 4B.

Figure 5B:
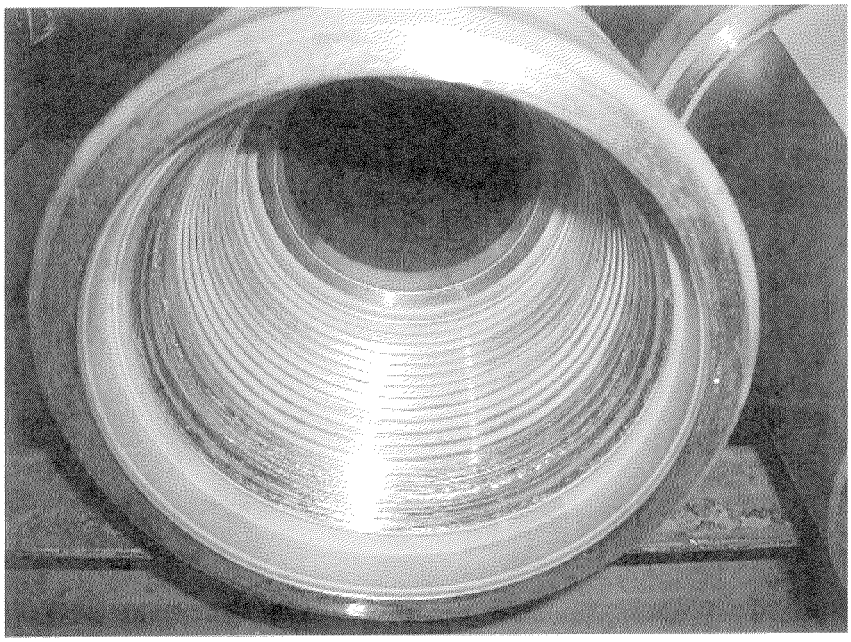
FIG. 5B is a photograph showing a surface state of a box on which the galling occurred after the make-up/break-out testing for the drill pipe tool joint.

On the contrary, in the make-up/break-out testing as shown in Table 1, galling occurred at a conventionally-used copper plated surface (plating thickness of 10-20 μm) of the pin 2 and the heavier copper plated surface (plating thickness of 20-30 μm) of the box 3 after repeating the make-up/break-out operation for around 10 times as shown in FIGS. 5A and 5B.

Advantages of the embodiment of the present invention are further exemplified.

According to the drill pipe tool joint and the corresponding drill pipe in the embodiment of the present invention, following advantages can be achieved.

(1) In the present embodiment, the male threaded portion 23 and the female threaded portion 33 have the surface layer consisting of a hard metal and the surface layer consisting of a soft material that are different in hardness from each other, respectively. Since the male threaded portion 23 and the female threaded portion 33 have the surface-treated surfaces having the different hardness, e.g., the combination of chromium plating and copper plating, respectively, the affinity between screwed surfaces in contact with each other is low. Thus, even though the make-up/break-out operation is performed repeatedly between the male threaded portion 23 and the female threaded portion 33, the occurrence of so-called "galling" can be suppressed. Therefore, the number of times of make-up/break-out operations until the occurrence of galling can be increased.

(2) From the relationship between the hardness ratio of the hard metal to the soft material and the number of times of make-up/break-out operations as shown in FIG. 3, it is confirmed that when the hardness ratio of the hard metal to the soft material is not less than 2.8, the number of times of make-up/break-out operations without any occurrence of galling is increased, particularly, the make-up/break-out operations for not less than 25 times as a practicable range for the drill pipe tool joint is possible. In the case that chromium plating or nickel plating is applied to the pin 2 while copper plating is applied to the box 3, the make-up/break-out operations until the occurrence of galling for not less than 50 times can be achieved.

(3) By applying the combination of the surface treatment with different hardness such as the combination of chromium plating and copper plating to the pin 2 and the box 3, the conventionally-used lubricating grease (or dope) is no longer required to be applied to the pin 2 and the box 3. Therefore, it is possible to achieve an environment-friendly drill pipe tool joint and a drill pipe with the same.

(4) By applying the combination of surface-treated surfaces having the hardness ratio of the hard metal to the soft material of not less than 2.8 to the screwed surfaces of the pin 2 and the box 3 that are subject to repetitive make-up/break-out operations, it is possible to achieve a significant advantage that the number of times of make-up/break-out operations without any occurrence of galling increases. From the graph of FIG. 3, it is understood that the hardness ratio of the hard metal to the soft material of 2.8 has a criticality, since the number of times of make-up/break-out operations without any occurrence of galling significantly changes before and after the hardness ratio of the hard metal to the soft material of 2.8. As shown by FIG. 3, results are furthermore increased when the hardness ratio of the hard metal to the soft material is equal or greater to 5, as for an example equal or greater than 6.

Although the invention has been described with respect to the specific embodiments, these embodiments are merely examples and do not limit the invention according to claims. These novel embodiments and modifications can be enforced in other various manners, and various omissions, replacements, alterations and the like may be made without going beyond the gist of the invention. All the combinations of the features described in the embodiments are not necessarily essential for the means for solving the problem of the Invention. Further, these embodiments and modifications are included in the scope and gist of the invention and the scope of the inventions described in claims and their equivalents.

INDUSTRIAL APPLICABILITY

A drill pipe tool joint and a corresponding drill pipe according to the present invention can be used without the use of a screw grease when the make-up/break-out operations of the drill pipe are performed for not less than 25 times, thereby being environment-friendly, as well as improving operating efficiency.

REFERENCE SIGNS LIST

1 Drill pipe tool joint
2 Pin
3 Box
4 Drill pipe
21 Outer surface of Pin
23 Male threaded portion
31 Inner surface of Box
33 Female threaded portion
50 Pipe body

The invention claimed is:

1. A dope-free drill pipe tool joint comprising:

a pin including a male threaded portion at an outer surface; and a box including a female threaded portion at an inner surface, the female threaded portion to be screwed and fastened to the male threaded portion in a contacting zone consisting of a male threaded contacting surface and a female threaded contacting surface;

wherein at least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and where said both surface portions are contacting surfaces after screwing;

wherein the drill pipe tool joint is dope free;

wherein a hardness ratio of the hard metal to the soft material is equal or greater than 2.8; and wherein the hardness ratio allows the pin and the box to be made up and broken out at least 25 times without any occurrence of galling.

2. The drill pipe tool joint of claim 1, wherein the male threaded contacting surface or the female threaded contacting surface is a surface layer consisting of a hard metal and respectively the female threaded contacting surface or the male threaded contacting surface is a surface layer consisting of a soft material.

3. The drill pipe tool joint of claim 1, wherein the hardness of the hard metal is equal or greater than 600 Hv.

4. The drill pipe tool joint of claim 1, wherein the hardness of the soft material is equal or lower than 350 Hv.

5. The drill pipe tool joint of claim 1, wherein the hard metal substantially consists of a metal chosen within the list consisting of chromium (Cr), nickel (Ni), or their mixture.

6. The drill pipe tool joint of claim 5, wherein the layer of hard metal is obtained through a plating process.

7. The drill pipe tool joint of claim 1 wherein the thickness of the layer of hard metal is comprised between 5 to 100 μm.

8. The drill pipe tool joint of claim 1, wherein the layer of soft material is obtained through a plating process.

9. The drill pipe tool joint of claim 1 wherein the thickness of the layer of soft material is comprised between 5 to 100 μm.

10. A method of assembling the drill pipe tool joint of claim 1, wherein the pin including the male threaded portion and the box including the female threaded portion are devoid of dope or of lubricant grease during make-up.

11. The drill pipe tool joint of claim 1, wherein the hardness ratio is between 2.8 and 10.

12. The drill pipe tool joint of claim 1, wherein the hardness ratio allows the pin and the box to be made up and broken out at least 50 times without any occurrence of galling.

13. The drill pipe tool joint of claim 1, wherein the soft material consists of a metal chosen within the list consisting of copper (Cu), zinc (Zn), or their mixture.

14. The drill pipe tool joint of claim 1, wherein the soft material substantially consists of a phosphate layer.

15. A dope-free drill pipe comprising:

a pipe body; and a pin including a male threaded portion at an outer surface; and a box including a female threaded portion at an inner surface, the female threaded portion to be screwed and fastened to a male threaded portion of another drill pipe of the same kind, in a contacting zone consisting of a male threaded contacting surface and a female threaded contacting surface;

wherein at least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and where said both surface portions are contacting surfaces after screwing;

wherein the drill pipe is dope free;

wherein a hardness ratio of the hard metal to the soft material is equal or greater than 2.8; and wherein the hardness ratio allows the pin and the box to be made up and broken out at least 25 times without any occurrence of galling.

16. The drill pipe of claim 15, wherein the male threaded contacting surface or the female threaded contacting surface is a surface layer consisting of a hard metal and respectively the female threaded contacting surface or the male threaded contacting surface is a surface layer consisting of a soft material.

17. The drill pipe of claim 15, wherein the hardness of the hard metal is equal or greater than 600 Hv.

18. The drill pipe of claim 15, wherein the hardness of the soft material is equal or lower than 350 Hv.

19. The drill pipe of claim 15, wherein the hard metal substantially consists of a metal chosen within the list consisting of chromium (Cr), nickel (Ni), or their mixture.

20. The drill pipe of claim 19, wherein the layer of hard metal is obtained through a plating process.

21. The drill pipe of claim 15, wherein the thickness of the layer of hard metal is comprised between 5 to 100 μm.

22. The drill pipe of claim 15, wherein the layer of soft material is obtained through a plating process.

23. The drill pipe of claim 15, wherein the thickness of the layer of soft material is comprised between 5 to 100 μm.

24. A method of assembling the drill pipe of claim 15, wherein the pin including the male threaded portion and the box including the female threaded portion are devoid of dope or of lubricant grease during make-up.

25. The drill pipe of claim 15, wherein the hardness ratio is between 2.8 and 10.

26. The drill pipe of claim 15, wherein the hardness ratio allows the pin and the box to be made up and broken out at least 50 times without any occurrence of galling.

27. The drill pipe of claim 15, wherein the soft material consists of a metal chosen within the list consisting of copper (Cu), zinc (Zn), or their mixture.

28. The drill pipe of claim 15, wherein the soft material substantially consists of a phosphate layer.

29. A dope-free drill pipe tool joint comprising:

a pin including a male threaded portion at an outer surface; and a box including a female threaded portion at an inner surface, the female threaded portion configured to be screwed and fastened to the male threaded portion in a contacting zone consisting of a male threaded contacting surface and a female threaded contacting surface;

wherein at least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and where said both surface portions are contacting surfaces after screwing;

wherein the drill pipe tool joint is dope free; and wherein a hardness ratio of the hard metal to the soft material is between 2.8 and 10.

30. A dope-free drill pipe comprising:

a pipe body; and a pin including a male threaded portion at an outer surface; and a box including a female threaded portion at an inner surface, the female threaded portion to be screwed and fastened to a male threaded portion of another drill pipe of the same kind, in a contacting zone consisting of a male threaded contacting surface and a female threaded contacting surface;

wherein at least a portion of the male threaded contacting surface or a portion of the female threaded contacting surface is a surface layer consisting of a hard metal and respectively at least a portion of the female threaded contacting surface or a portion of the male threaded contacting surface is a surface layer consisting of a soft material and where said both surface portions are contacting surfaces after screwing;

wherein the drill pipe is dope free; and wherein a hardness ratio of the hard metal to the soft material is between 2.8 and 10.

* * * * *